US005394293A

United States Patent [19]

Grarovsky

[11] Patent Number: 5,394,293

[45] Date of Patent: Feb. 28, 1995

[54] ELECTRONIC STATIC NEUTRALIZER DEVICE

[75] Inventor: Boris Grarovsky, Kharkov, Ukraine

[73] Assignee: Julie Associates, Inc., Billerica, Mass.

[21] Appl. No.: 14,772

[22] Filed: Feb. 8, 1993

[51] Int. Cl.[6] ..... H05F 3/06

[52] U.S. Cl. ..... 361/221; 361/212

[58] Field of Search ..... 250/324, 325, 326; 361/214, 221, 231, 230, 235, 212

[56] References Cited

U.S. PATENT DOCUMENTS

| | | | |
|---|---|---|---|
| 4,092,543 | 5/1978 | Levy | 361/213 |
| 4,307,432 | 12/1981 | Nishikawa | 361/221 |
| 4,336,565 | 6/1982 | Murray et al. | 361/225 |
| 4,363,070 | 12/1982 | Kisler | 361/212 |
| 4,383,752 | 5/1983 | Kisler | 361/230 |
| 4,517,143 | 5/1985 | Kisler | 361/221 |
| 4,579,441 | 4/1986 | Hart et al. | 355/3 CH |
| 4,673,885 | 6/1987 | Lewiner et al. | 361/220 |
| 4,771,360 | 9/1988 | Ayash | 361/221 |
| 4,810,432 | 3/1989 | Kisler | 361/221 |
| 4,825,334 | 4/1989 | Kisler | 361/221 |
| 4,994,861 | 2/1991 | Brandon et al. | 361/221 |

*Primary Examiner*—Jeffrey A. Gaffin
*Assistant Examiner*—Peter Ganjoo
*Attorney, Agent, or Firm*—Pearson & Pearson

[57] ABSTRACT

Apparatus for ionizing a gas. The apparatus includes an ionizing generator with an insulating frame, an electrical insulator and a conductive brush formed of individual bristles. An ionizing power supply connects to the conductive frame and the electrically conductive brush. When a threshold potential is applied by the power supply, ionizing discharges emanate from the free ends of individual conductive wires in the brush and establish discharge paths with the conductive frame thereby to produce a volume of ionized gas.

22 Claims, 3 Drawing Sheets

ELECTRONIC STATIC NEUTRALIZER DEVICE

BACKGROUND OF THE INVENTION

1. Field of the Invention

This invention generally relates to the field of gas ionization and more particularly to apparatus for ionizing gas in a local area.

2. Description of Related Art

Certain properties of ionized gas make it attractive to different industrial applications, particularly, those involving the control of an electrostatic charge on a body. In such applications, a gas ionizing apparatus produces an ionization and electrical field that causes the air molecules in the vicinity of the apparatus to break into positive and negative electrons. As opposite charges attract, any charged material passing near the apparatus will attract ions until the charge is neutralized.

In accordance with the prior art, gas ionizing apparatus typically includes an insulator that supports a series of spaced, discrete pointed electrodes proximate a ground reference frame that is isolated from the electrodes. When a voltage of about 3 KV or more is applied across the electrodes and frame, a discharge occurs that ionizes gas in the vicinity of the electrode.

The spacing of the electrodes can produce discrete regions of ionization. More specifically, as a pointed electrode tip becomes dull through use or is coated with dust or other materials from the environment, the ionization rate from that electrode can reduce or even stop an obvious expedient for improving uniformity by merging the discrete regions might be realized by reducing the electrode spacing. However, there is minimum spacing beyond which further decreases in the spacing reduce the ionization from each electrode. In some situations ionization from one electrode may even stop. Moreover, the problems of dulling the points and accumulations on the points continue to exist. Consequently, these prior art devices do not readily respond or adjust to these situations.

Charged or grounded conductive brushes have also been used to control charges on a body. For example, the following United States Letters Patent discloses apparatus for ionizing gas to neutralize the charge on a moving web:

U.S. Pat. No. 4,307,432 (1981) Nishikawa

In accordance with U.S. Pat. No. 4,307,432, a charge neutralizing apparatus includes a brush of thin conductive wires. Free ends of the wires that are brought into proximity with, but spaced from, a charged web. The charge on the web produces an electric field at the free end of a wire that allows gas at the free ends of the brush to ionize and neutralize any charge on the material. The range of spacing between the brush ends and the material is limited to about 0.5 mm to 2 mm. Moreover, the rate of ionization is dependent upon the charge on the moving web. Consequently, it is difficult to control the rate of ionization. Moreover, it is difficult to position the brushes at any significant distance from the material being treated. Finally, the structure does not constitute an independent, self-contained gas ionizer.

The following patents disclose apparatus for controlling the charge on a material generally in response to an electric field:

| | |
|---|---|
| 4,336,565 | (1982) Murray et al |
| 4,363,070 | (1982) Kisler |
| 4,383,752 | (1983) Kisler |
| 4,517,143 | (1985) Kisler |
| 4,810,432 | (1989) Kisler |
| 4,825,334 | (1989) Kisler |

U.S. Pat. No. 4,336,565 discloses a process for imposing an electrical charge on an electrically insulating surface of a moving web. A brush, comprising extremely soft and flexible fiber filaments such as carbon filaments, contacts one surface of the web and transfers a charge to that surface. This apparatus produces an electric field between the brush and a ground plane disposed on the other side of the web.

In U.S. Pat. No. 4,363,070 a brush-like device has an array of conductive filaments for neutralizing electrostatic charges on a moving web. In this apparatus a web of charge-retaining material passes a grounding brush and a second brush that subjects the material to an alternating electrical field. The alternating field is generated between the second brush and a grounded roller that are oppositely disposed with respect to the web. An electrostatic charge sensor and related control circuitry maintain the web at a substantially uncharged condition.

U.S. Pat. No. 4,383,752 discloses a power supply for producing an electric field between a brush electrode and a rotating roller disposed oppositely with respect to a web. This patent also discloses a current limiting resistor in series with the conductive brush.

U.S. Pat. No. 4,517,143 discloses a method and apparatus for establishing a uniform charge level on a randomly charged web. The apparatus generates first and second uniform electrostatic fields of different magnitudes and of opposite polarities between grounded rollers and spaced brush electrodes. As a web moves between each of the brush electrodes and its respective roller, a charge accumulates on the material. U.S. Pat. No. 4,810,432 describes a similar structure. This patent further discloses apparatus for mechanically vibrating the brush electrodes to assure a uniform charge distribution.

In accordance with U.S. Pat. No. 4,825,334 a power supply energizes a conductive brush with respect to a grounded roller that transports a web material between the roller and brush. The apparatus prevents the production of corona at the tips of the individual brush bristles by limiting current to the microamp range.

Other patents that utilize bristle brushes primarily for neutralizing charge are disclosed in the following patents:

| | |
|---|---|
| 4,579,441 | (1986) Hart et al |
| 4,771,369 | (1988) Ayash |
| 4,994,861 | (1991) Brandon et al |

U.S. Pat. No. 4,579,441 discloses an electrostatographic apparatus that includes an imaging surface with an electrostatic device for transferring toner particles. A plurality of conductive fibers extend across the rear side of a receiving sheet and are spaced from the sheet. A low voltage direct current .potential applied to those fibers has a polarity opposite the polarity on a receiving sheet to neutralize the charge.

U.S. Pat. No. 4,771,360 depicts a brush for grounding a component that includes a support member having a multiplicity of fibers mounted thereon. The grounding brush contacts various rolls and shafts of a printing machine thereby to dissipate any electrostatic charges.

The apparatus in U.S. Pat. No. 4,994,861 performs a similar charge neutralizing function. A grounded wire located in proximity to a sheet neutralizes any accumulated charge on the sheet. This system includes a grounded conductive brush mounted on a sheet deflector so that one end of the brush contacts sheets as they traverse a first sheet feed path.

Apparatus relying on electrostatic fields has certain common characteristics. Each generates an electric field between a brush conductor and a spaced electrode for acting on an intermediate web. Consequently each requires a separate grounding electrode that must be supported on a machine independently of the conducting brush. In these structures the spacing between the ends of the brush bristles and the web and the spacing between the brush bristles and the complementary machine electrode are critical to the strength and uniformity of the electrostatic field and the efficiency with which the apparatus charges or neutralizes the web. Certain of the devices, particularly the grounding brushes, maintain physical contact with the material being modified thereby providing friction and potential surface marring. None of the references discloses a device that constitutes a self-contained, independent, non-contacting apparatus for controlling the charge on a web.

SUMMARY

Therefore it is an object of this invention to provide a self-contained apparatus for ionizing gas.

Another object of this invention is to provide selfcontained apparatus for ionizing gas that produces the ionization independently of any material or machinery for handling such material.

Still another object of this invention is to provide a self-contained apparatus for producing an ionizing gas that operates in a spaced relationship to a moving web or other dielectric material.

Yet another object is to provide a self-contained apparatus for producing an ionizing gas that automatically adjusts to changing operating conditions as individual electrodes dull or are coated with dielectric materials.

Yet still another object of this invention is to provide a self-contained, self-adjusting apparatus for ionizing gas that is simple to construct and reliable to use and that is adapted for use in a variety of applications.

In accordance with one aspect of this invention, a gas ionizing generator includes a conductive frame, a plurality of conductive wires and an electrically isolating structure. The conductive frame connects to a first power supply terminal. The plurality of conductive wires connect in parallel to a second power supply terminal. The electrically isolating structure mounts to the frame and supports the wires thereby to electrically isolate the wires and the frame. When energized by a power supply, the ends of the wire ionize surrounding gas and establish an ionizing current path between the ends of the wires and the conductive frame.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF ILLUSTRATIVE EMBODIMENTS

Figure 1:
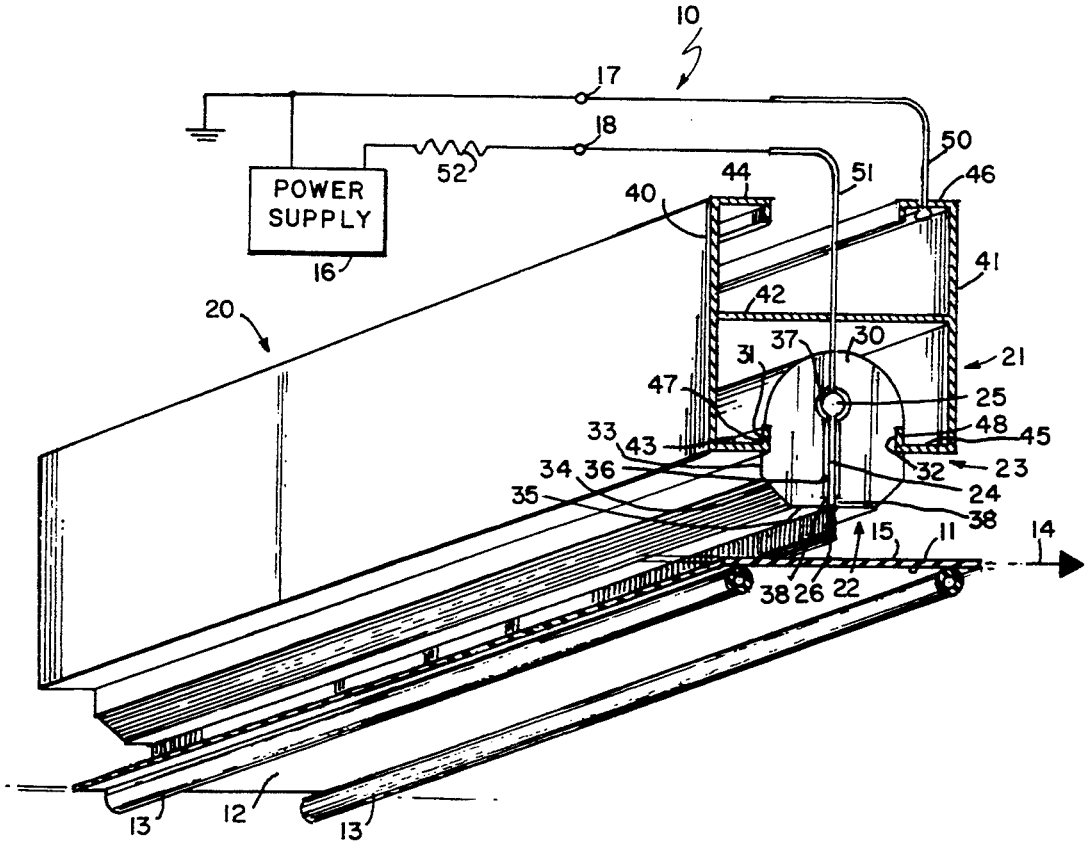
FIG. 1 is a perspective of a gas ionizing apparatus constructed in accordance with this invention.
Figure 2:
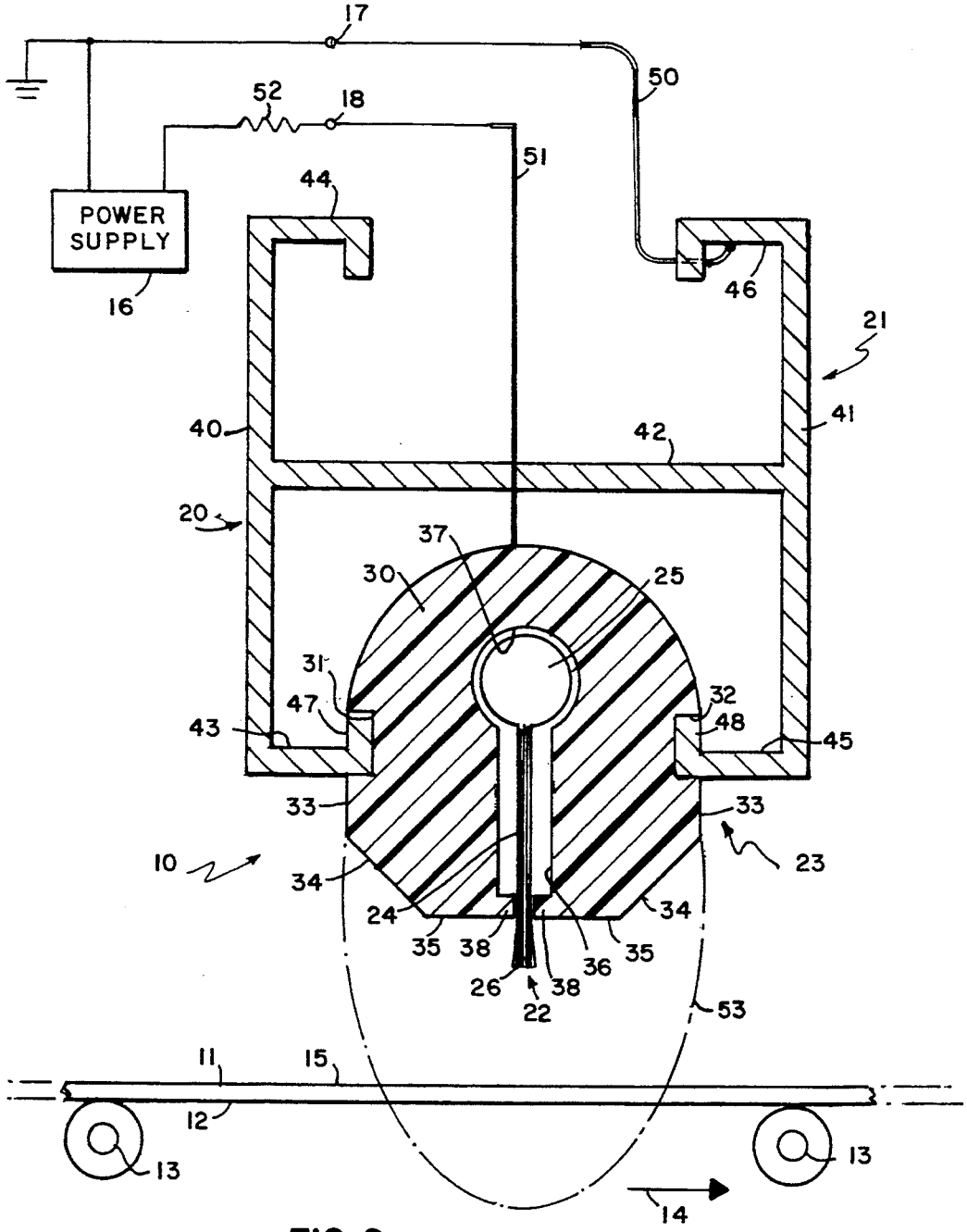
FIG. 2 is an enlarged cross section view taken along lines 2—2 in FIG. 1 that depicts the use of the apparatus in connection with a moving web.

As particularly shown in FIGS. 1 and 2, gas ionizing apparatus 10 constructed in accordance with this invention is disposed on one side of a web 11 having a lower surface 12 that passes over rollers 13 and moves in direction of an arrow 14. In the orientation of FIGS. 1 and 2, the apparatus 10 is spaced from an upper surface 15 of the web 11. In other applications the apparatus 10 could located below the web 11.

A power supply 16 with a first output terminal 17 and a second output terminal 18 provides an ionizing potential. Typically the first terminal 16 will be at a ground potential while the second terminal 17 will be at a positive, negative or alternating potential.

A self-contained ionizing generator 20 at the heart of this invention includes a conductive frame 21, a conductive brush assembly 22 and an electrically isolating member 23. The isolating member 23 spaces the electrical brush 22 from the conductive frame 21. When the conductive frame 21 is connected to the first terminal 17 and the conductive brush 22 is attached to the terminal 18, gas in the vicinity of the ionizing generator 20 will ionize at an ionizing potential. Like power supplies used in prior art, the ionizing generator 20 begins to ionize gas at about 3 kV and produces reliable ionization over a range from 4 kV to 100 kV.

Referring to the conductive brush 22, a plurality of individual conductive wires or bristles 24 are bound in a header 25 by conventional means so the individual bristles or wires are electrically in parallel. Free ends 26 of the conductive bristles 24 are cut with relatively sharp edges, and the bristles are bound with a density in the range from 100 to 10,000 bristles per inch and can have diameters ranging from 1 $\mu$m to 15 $\mu$m.

Figure 3:
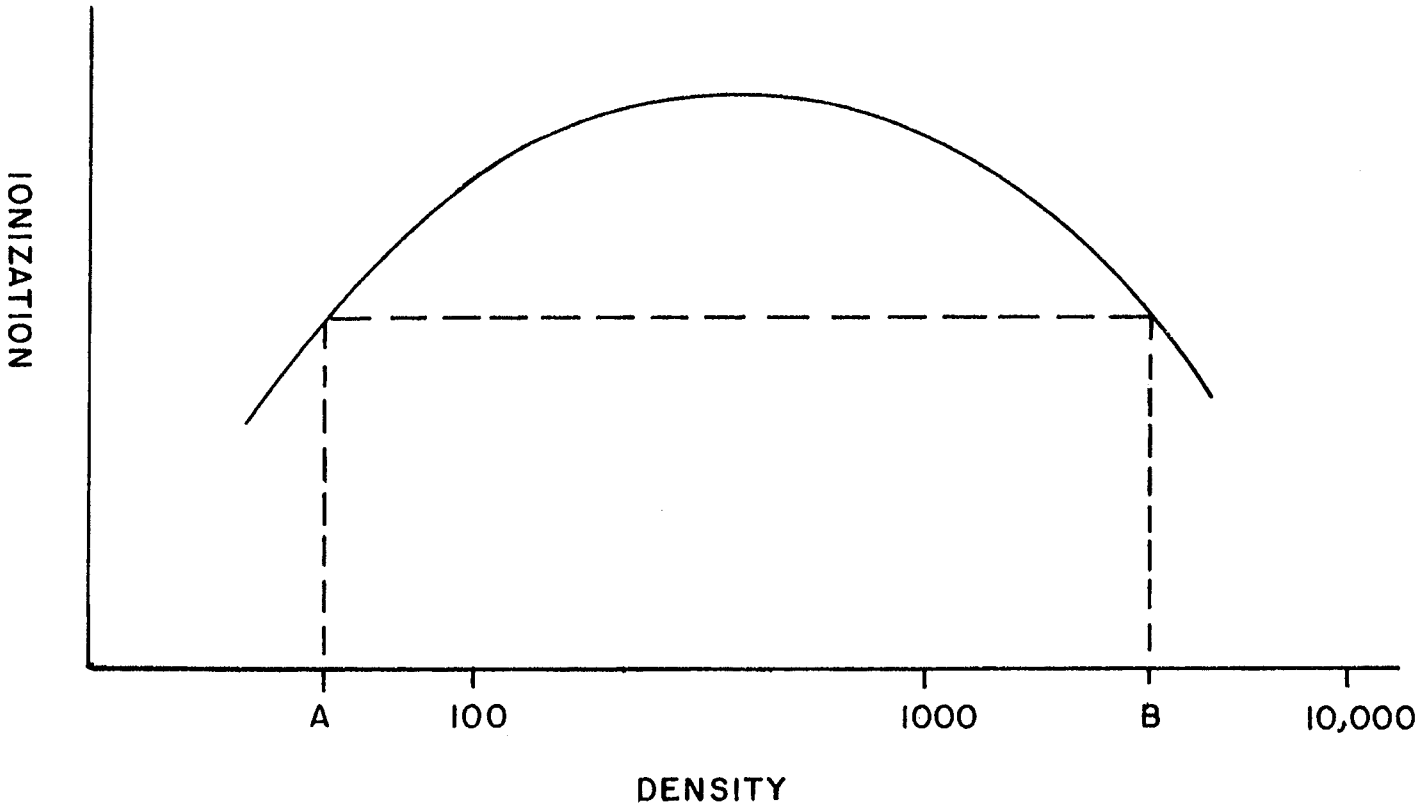
FIG. 3 is a graph that qualitatively depicts the relationship between ionization and density of bristles in a brush.

FIG. 3 depicts a curve 27 that qualitatively represents, for a given voltage, the changes in ionization production as a function of bristle density. As shown effective ionization occurs between about densities from less than 100 bristles per inch to over 5000 bristles per inch. Peak ionization seems to occur at a density of about 600 bristles per inch.

The isolating member 23 provides electrical isolation between the conductive frame 21 and the conductive brush 22. In one particular embodiment the isolating member 23 comprises a polytetrafluoroethylene extrusion having a central base portion 30 and side recesses 31 and 32. Between the side recesses 31 and 32 and the tips of the brush 26, the isolating member 23 is formed with a series of longitudinally extending intersecting surfaces 33, 34 and 35. As known in the art, these intersecting surfaces increase the magnitude of any potential breakdown voltage thereby to minimize premature arcing by extending the length of the path over the surfaces between the brush 24 and frame 21.

The isolating means 32 additionally includes a longitudinally extending slot 36 with, in this particular embodiment, a cavity 37 at an inward termination and lips 38 at an outer termination that partially close the slot 36. The cavity 37 and slot 36 accommodate the header 25 and the individual bristles 24 of the brush and hold them securely in the insulator body 32 with the lips 38 compressing and securing the bristles 24.

The conductive frame 21 includes two parallel legs 40 and 41 shown in a vertical orientation in FIGS. 1 and 2 with an interconnecting central web 42. Each end of each leg includes a support structure; and support structures on opposite legs are counterfacing. In the orientation of FIGS. 1 and 2 the leg 40 terminates with a lower inturned channel 43 and an upper inturned channel 44 while the leg 41 terminates with lower and upper inturned channels 45 and 46, respectively. Each channel has a similar structure, with the channel 43 including a short return 47 that extends parallel to the leg 40 and fits in the recess 33. Likewise the channel 45 has a return 48 that fits in the recess 34. The rigidity of the frame 21 maintains the spacing between the counterfacing channels 43 and 45 thereby to reliably position and support the insulating body 32. The other channels 45 and 46 and portions of the frame 21 on the same side of the web 42 facilitate the attachment of the ionizing generator 20 to materials handling apparatus.

A conductor 50 connects the conductive frame 21 to the terminal 17 from the power supply 16. A conductor 51 connects to the brush header 25 and to the terminal 18. A current limiting resistor 52 is interposed between the power supply 16 and the terminal 18 to limit the ionizing current to an appropriate level for a given application. More specifically, there is a possibility that the ionizing current can exceed a necessary level for maintaining adequate ionization levels particularly in the upper range of applied ionizing voltage. Current can increase to levels at which the ends of the filaments dull more quickly or even melt. The current limiting resistor 52 allows the system to operate at a variety of operating voltages while still limiting the current to levels at which the ionization continues reliably.

If the power supply 16 produces a potential of at least 4 kV and preferably between 5 kV and 20 kV, each of the bristles 24 reaches the same potential. As individual bristles 24 are cut for placement in the brush 23, the free ends 26 will not have identical cross-sections. Rather, there will be a distribution of bristles of different sharpness and end configurations. Statistically the distribution of these individual shapes will be random. Consequently certain of the individual bristles 24 will ionize gas before other proximate bristles. Specifically, the "sharpest" bristle 24 in an area will start to ionize gas first. Over time, discharge eventually will erode the free end of an ionizing bristle. Then an adjacent bristle, that becomes sharper, will ionize gas. This transfer will occur automatically and effectively will increase the life of the brush. Thus, looking at the conductive brush 23 globally, the brush 23 produces a plurality of ionizing points evenly distributed over the length of the brush assembly 22. Moreover, each bristle 24 has a discharge path to the frame 21, particularly the channels 43 and 45. Thus, the brush 23 operates with a plurality of discharge paths of substantially equal length.

FIGS. 1 and 2 therefore disclose an apparatus that fulfills the objects of this invention. Specifically, the ionizing generator 20 constitutes a self-contained structure for ionizing gas. The generator 20 is positioned on one side of the web 11. It is not dependent of any structure in the web handling apparatus for a discharge path. It produces a volume of ionized gas, depicted by dashed line 53 that allows the free ends 26 of the bristles to be spaced up to 15 cm or more from the web 11. Each of the conductive frame 21 and insulator 23 are readily produced by inexpensive extrusion methods. As the unit is self-contained, it is not only simple to construct it is also reliable in use and inexpensive to manufacture.

This invention has been disclosed in terms of certain embodiments. It will be apparent, however, that a number of modifications can be made to the specifically disclosed apparatus while obtaining some or all of the above objects and advantages of this invention. Different insulating structure and different insulating materials can be substituted for the particular polytetrafluoroethylene insulator disclosed with respect to this particular embodiment. It is merely required that the material be compatible with the environment and exhibit high surface resistivity and dielectric strength for the applied potentials. Different insulating surface configurations could be utilized to increase the surface path between the frame 21 and the conductive brush 22. The frame 21 could be modified for other applications. Different brush structures and materials can be utilized so long as the free ends 26 of the wires are sharp. Therefore, it is the intent of the appended claims to cover all such variations and modifications as come within the true spirit and scope of this invention.

What is claimed as new and desired to be secured by Letters Patent of the United States is:

1. A gas ionizing generator that connects to a power supply with first and second terminals for ionizing a gas comprising:

A. conductive frame means for location in the gas and having connection means for attachment to the first terminal, B. electrode means including a plurality of parallel conductive wires having corresponding free ends thereof formed with sharp edges and being connectible to the second terminal, and C. elongated electrical isolating means supported along its length by said frame means intermediate said frame means and said electrode means for supporting said electrode means in electrical isolation with respect to said frame means and with said free ends being spaced from said frame means whereby the application of a voltage across said frame means and electrode means initiates ionization of the gas proximate said free ends with a current path extending from said frame means through the gas to said free ends.

2. An ionizing generator as recited in claim 1 wherein said conductive wires are constituted by electrically conductive bristles in a conductive brush additionally including a brush header in which the bristles are tightly packed and in electrical contact with each other, said brush header being attached brush connection means.

3. An ionizing generator as recited in claim 2 wherein said the density of bristle packing is between 100 and 10,000 bristles per inch.

4. An ionizing generator as recited in claim 1 wherein said electrical isolating means comprises an material that is an electrical insulator at the ionizing potential.

5. An ionizing generator as recited in claim 4 wherein said electrode means is elongated along an electrode axis and wherein at least the surface of said electrical isolating means intermediate said electrode means and said conductive frame means is formed with intersecting surfaces that extend parallel to the electrode axis.

6. An ionizing generator as recited in claim 4 wherein said insulator material is formed of an extrudable material that has high surface and volume resistivities and high electrical arc resistance.

7. An ionizing generator as recited in claim 6 wherein said insulator material is formed of polytetrafluoroethylene.

8. An ionizing generator as recited in claim 4 wherein said conductive wires are constituted by electrically conductive bristles in a conductive brush additionally including a brush header in which the bristles are tightly packed and in electrical contact with each other, said brush header being attached brush connection means.

9. An ionizing generator as recited in claim 8 wherein said the density of bristle packing is between 100 and 10,000 bristles per inch.

10. An ionizing generator as recited in claim 9 wherein said insulator material is formed of an extrudable material that has high surface and volume resistivities and high electrical arc resistance.

11. An ionizing generator as recited in claim 10 wherein said insulator material is formed of polytetrafluoroethylene.

12. An ionizing generator as recited in claim 11 wherein said conductive wires are constituted by electrically conductive bristles in a conductive brush additionally including a brush header in which the bristles are tightly packed and in electrical contact with each other, said brush header being attached brush connection means.

13. Apparatus for ionizing gas comprising:

A. a power supply with first and second terminals, and

B. an ionizing gas generator including:

i. an elongated conductive frame means for location in the gas and having first and second spaced, parallel legs and a central interconnecting web extending along a longitudinal axis, one end of each of said legs terminating with couterfacing support means that partially close the spacing between said legs, said frame means having means for connection to the first terminal, ii. an elongated electrical insulator carried intermediate said counterfacing support means and including a longitudinally extending slot therein intermediate said leg means and electrically isolated from said frame means, and iii. conductive brush means formed of individual conductive bristles tightly packed together at one end and extending to free ends having sharp edges, said one end of said brush means being carried in the slot of said insulating means for attachment to the second terminal whereby energization of said ionizing electrode produces a gas ionizing discharge between said conductive brush means and said conductive frame means through said gas.

14. Ionizing apparatus as recited in claim 13 wherein said insulator is formed of an extrudable material that has high surface and volume resistivities and high electrical arc resistance.

15. Ionizing apparatus as recited in claim 13 wherein said insulator is formed of polytetrafluoroethylene.

16. Ionizing apparatus as recited in claim 15 wherein said insulator is formed of an extrudable material that has high surface and volume resistivities and high electrical arc resistance.

17. Ionizing apparatus as recited in claim 16 wherein said insulator is formed of polytetrafluoroethylene.

18. Ionizing apparatus as recited in claim 13 wherein said insulator is extruded along the longitudinal axis and the surface between said conductive frame means and said conductive brush means includes longitudinally extending, intersecting surfaces.

19. Ionizing apparatus as recited in claim 13 wherein said the density of said individual bristles is between 100 and 10,000 bristles per inch.

20. Ionizing apparatus as recited in claim 19, wherein said insulator is extruded along the longitudinal axis and the surface between said conductive frame means and said conductive brush means comprises longitudinally extending, intersecting surfaces.

21. Ionizing apparatus as recited in claim 20 wherein said insulator is formed of an extrudable material that has high surface and volume resistivities and high electrical arc resistance.

22. Ionizing apparatus as recited in claim 21 wherein said insulator is formed of polytetrafluoroethylene.

* * * * *

UNITED STATES PATENT AND TRADEMARK OFFICE

CERTIFICATE OF CORRECTION

PATENT NO. : 5,394,293

DATED : February 28,1995

INVENTOR(S) : Boris Granovsky

It is certified that error appears in the above-identified patent and that said Letters Patent is hereby corrected as shown below:

On the title page, under item [19], and in item [75], change "Grarovsky" to --Granovsky--.

Signed and Sealed this

Ninth Day of May, 1995

*Attest:*

*Attesting Officer*

BRUCE LEHMAN

*Commissioner of Patents and Trademarks*